US005449179A

United States Patent [19]

Hefferan

[11] Patent Number: 5,449,179

[45] Date of Patent: Sep. 12, 1995

[54] HOLIDAY BINGO HAVING STICKERS AND CANDY MARKERS

[76] Inventor: Laurel A. Hefferan, 173 Fawn Valley Dr., McMurray, Pa. 15317

[21] Appl. No.: 218,830

[22] Filed: Mar. 28, 1994

[51] Int. Cl.[6] ..... A63F 3/06

[52] U.S. Cl. ..... 273/269; 273/282.1; 446/901

[58] Field of Search ..... 273/269, 270, 282.1; 446/901

[56] References Cited

U.S. PATENT DOCUMENTS

| | | | |
|---|---|---|---|
| 2,484,143 | 10/1949 | Arnold | 273/269 |
| 2,585,924 | 2/1952 | Freedman et al. | 446/901 |
| 4,046,382 | 9/1977 | Ratzkoff | 273/269 |
| 5,139,270 | 8/1992 | Gernhofer | 273/269 |

FOREIGN PATENT DOCUMENTS

| | | | |
|---|---|---|---|
| 1500257 | 9/1967 | France | 273/286 |

OTHER PUBLICATIONS

Cadaco, "Ting-a-Ling Bingo", Playthings Jun. 1968, p. 5.

*Primary Examiner*—Vincent Millin
*Assistant Examiner*—William M. Pierce
*Attorney, Agent, or Firm*—George C. Atwell

[57] ABSTRACT

A holiday Bingo-type game which incorporates motifs from various holidays, such as Easter, Christmas, and Halloween, includes a master calling card having grids each of which contains indicia or symbols representative of a particular holiday, a plurality of game playing cards having grids which contain indicia or symbols corresponding to those found on the master calling card, and a plurality of markers containing symbols or pictures representative of the particular holiday. Also disclosed is a Bible story Bingo-type game which includes at least one master calling card whose grids contain illustrations of Biblical events, a plurality of playing cards whose grids contain illustrations of Biblical events and which correspond to the illustrations on the master calling card, and markers having Biblically-oriented symbols placed thereon.

3 Claims, 13 Drawing Sheets

HOLIDAY BINGO HAVING STICKERS AND CANDY MARKERS

BACKGROUND OF THE INVENTION

This invention relates to Bingo-type games, and more particularly pertains to a Bingo-type game that incorporates motifs, symbols, and illustrations from various holidays, such as Easter, Halloween, and Christmas, in the play of the game.

The original Bingo game is perhaps one of the most popular games ever devised. The original Bingo game includes a number of attractive features which are an essential part of its widespread popularity: 1) it can be played anywhere, i.e., at home, school, church, firehall, senior citizens center, etc.; 2) the playing pieces are easy to set up and easy to transport; 3) the game itself can be quickly learned and mastered, and can be played by anyone commencing from approximately age 5 and up; and 4) the game itself can be played in a short amount of time, and depending upon the setting, at the conclusion of the game there may be some type of pay-off for the winner.

Obviously, because the game of Bingo has such commendable attributes, the format and manner of play of the game has been adapted by numerous other games. For example, the Frischmann et. al. sound Bingo game, U.S. Pat. No. 4,169,601, represents one adaptation. The Frischmann et. al. patent includes a set of playing cards having the format of Bingo playing cards except each grid contains a unique picture of a sound-emitting object instead of a number. Imprinted on a phonograph record are the actual sounds produced by the various objects pictured on all the playing cards, and as the record is played, the players cover the pictures of the objects found on their respective playing cards which correspond to the particular sound played by the record. The first player to cover the grids on his or her playing card in a manner similar to conventional Bingo is declared the winner. The Gernhofer patent, U.S. Pat. No. 5,139,270, utilizes the same format as the conventional Bingo game but fills each grid with a picture representing a circus scene or leaves the grid blank so that the player can insert his or her name within that open grid space.

Despite the ingenuity of the above Bingo-type games, there remains a need for a Bingo-type game which is directed toward children and which incorporates motifs from various holidays, such as Easter, Halloween, Christmas, etc.

SUMMARY OF THE INVENTION

The present invention comprehends a holiday Bingo-type game which incorporates motifs from popularly celebrated holidays, such as Easter, Halloween, Christmas, etc., and is directed toward children for play in a school, church, day care or home setting.

The holiday Bingo-type game includes a plurality of game playing cards with each game playing card containing a plurality of grids, and each grid containing a unique symbol or indicium corresponding to symbols commonly associated with a particular holiday. At least one master calling card is issued, and the master calling card contains a plurality of grids with each grid containing a unique symbol or indicium corresponding to symbols commonly associated with the particular holiday and also to the indicia contained within the grids of the game playing cards. For an Easter version of the holiday Bingo-type game, the indicia on the game playing cards would correspond to the indicia on the master calling card, and likewise for Halloween or Christmas versions of the game. The master calling card for each version of the game contains more grids and, therefore, more symbols than any of the respective game playing cards for that version of the game. With each version of the holiday Bingo-type game, a plurality of markers are used that symbolize (or include symbols placed thereon) the respective version of the game. For example, the Christmas version of the game may use red and green M&M markers or disc-shaped markers having a clear face for enclosing a Christmas scene, such as a reindeer or a snowman, therein and which give a snow-like illusion when shaken. The Easter version of the game may include pastel-colored M&M markers and the Halloween version of the game may include candy corn markers or discs containing symbols or scenes representative of Halloween, such as a ghost, skeleton, or pumpkin. For all versions of the holiday Bingo-type game, the markers are used to cover the grid on each player's game playing card as the indicia of the master calling card are sequentially called out during play of the game. The first player to cover a series of grids on his or her game playing card in a manner similar to the conventional Bingo game is declared the winner.

In addition to the three representative versions of the holiday Bingo-type game, a Bible story Bingo-type game is also disclosed which includes a plurality of Bible story playing cards with each Bible story playing card containing a plurality of grids, and each grid containing a unique illustration representing a Biblical event. The Bible story Bingo-type game also includes at least one Bible story master calling card which contains a plurality of grids, and each grid contains a unique illustration representing a particular Biblical event corresponding to the illustrated Biblical events found on the Bible story master calling card. Also, the Bible story Bingo-type game includes a plurality of Bible story cards with each Bible story card having a unique written description thereon of the Biblical event which corresponds to one of the illustrated Biblical events on the Bible story master calling card. Each player is given a plurality of markers to cover the appropriate illustrated Biblical event on his or her Bible story playing card as that illustration is called out by random selection of the Bible story cards during play of the game, and the markers may have a Biblical/religious symbol placed thereon, such as a cross or a torah.

It is an objective of the present invention to provide a Bingo-type game which children can easily learn to play, and which includes colorful playing cards and markers for aesthetic enhancement and appeal.

It is another objective of the present invention to provide a Bible story Bingo-type game which facilitates the learning of Biblical stories and events by children in a pleasurable game setting.

These and other objects will be readily evident upon a study of the following specification and the accompanying drawings wherein:

DETAILED DESCRIPTION OF THE PREFERRED EMBODIMENTS

Illustrated in FIGS. 1–6 are various elements used in a holiday Bingo-type game for play by children in various settings, such as home, school, church, or at day care centers. The game incorporates motifs from various holidays to enhance its aesthetic appeal and also to increase children's interest in the game. The motifs incorporated into the games are the well-known symbols and designs for the various holiday seasons: for example, Easter bunnies and jelly beans for Easter, pumpkins and broomsticks for Halloween, candy canes and mistletoe for Christmas. The rules and method of play of the holiday Bingo-type game are very similar to the well-known conventional Bingo game. The holiday Bingo-type game can incorporate motifs from any holiday; in the preferred embodiment of the game of the present invention the holidays chosen are Easter, Halloween, and Christmas. In addition to these, other holidays may be included in the holiday Bingo-type game, such as Thanksgiving, Valentine's Day, Martin Luther King's birthday, St. Patrick's Day, Fourth of July, Memorial Day, Columbus Day, Veteran's Day, and New Year's Day.

Figure 2:
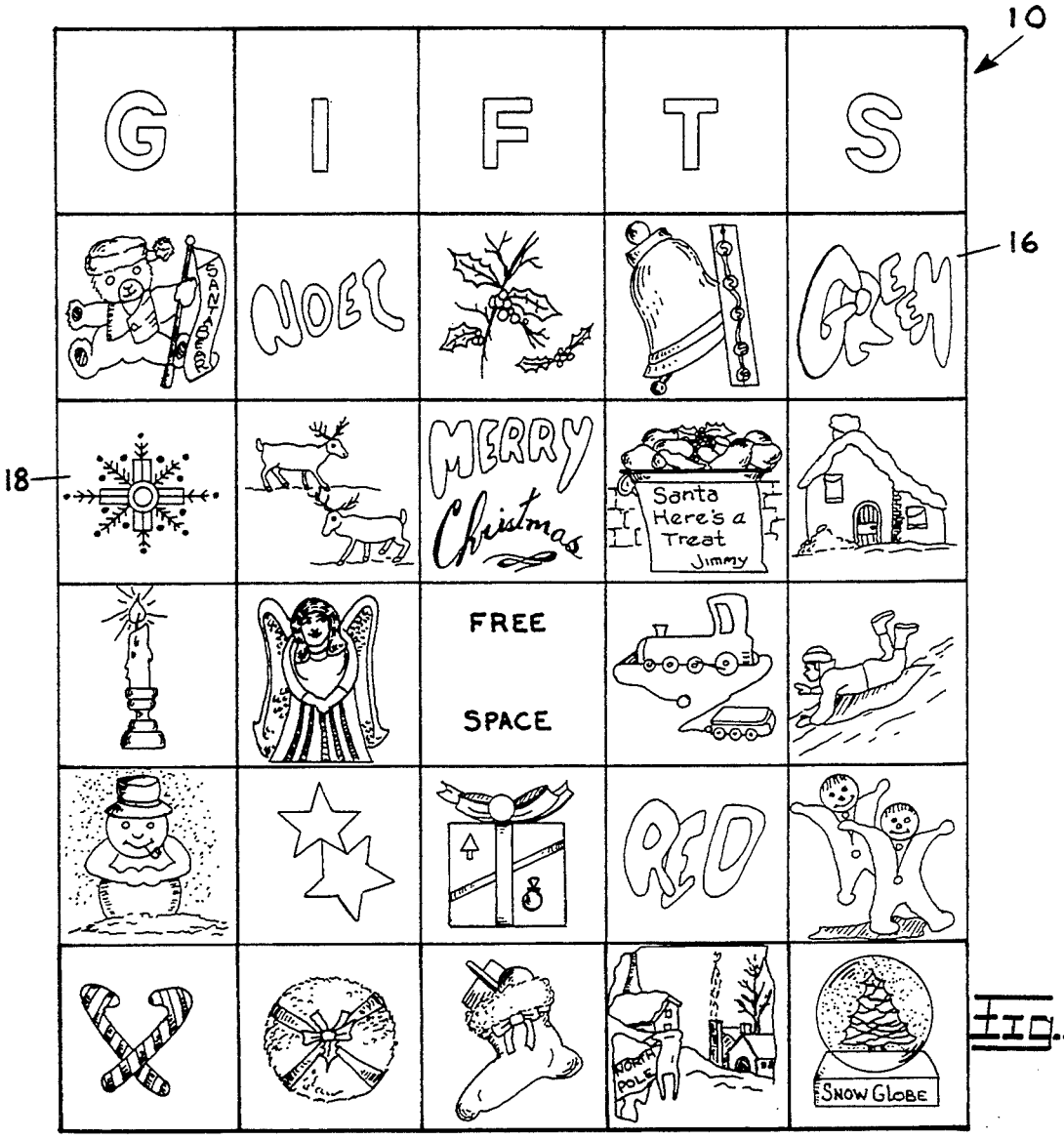
FIG.2 illustrates a representative game playing card for a Christmas version of the holiday Bingo-type game.
Figure 4:
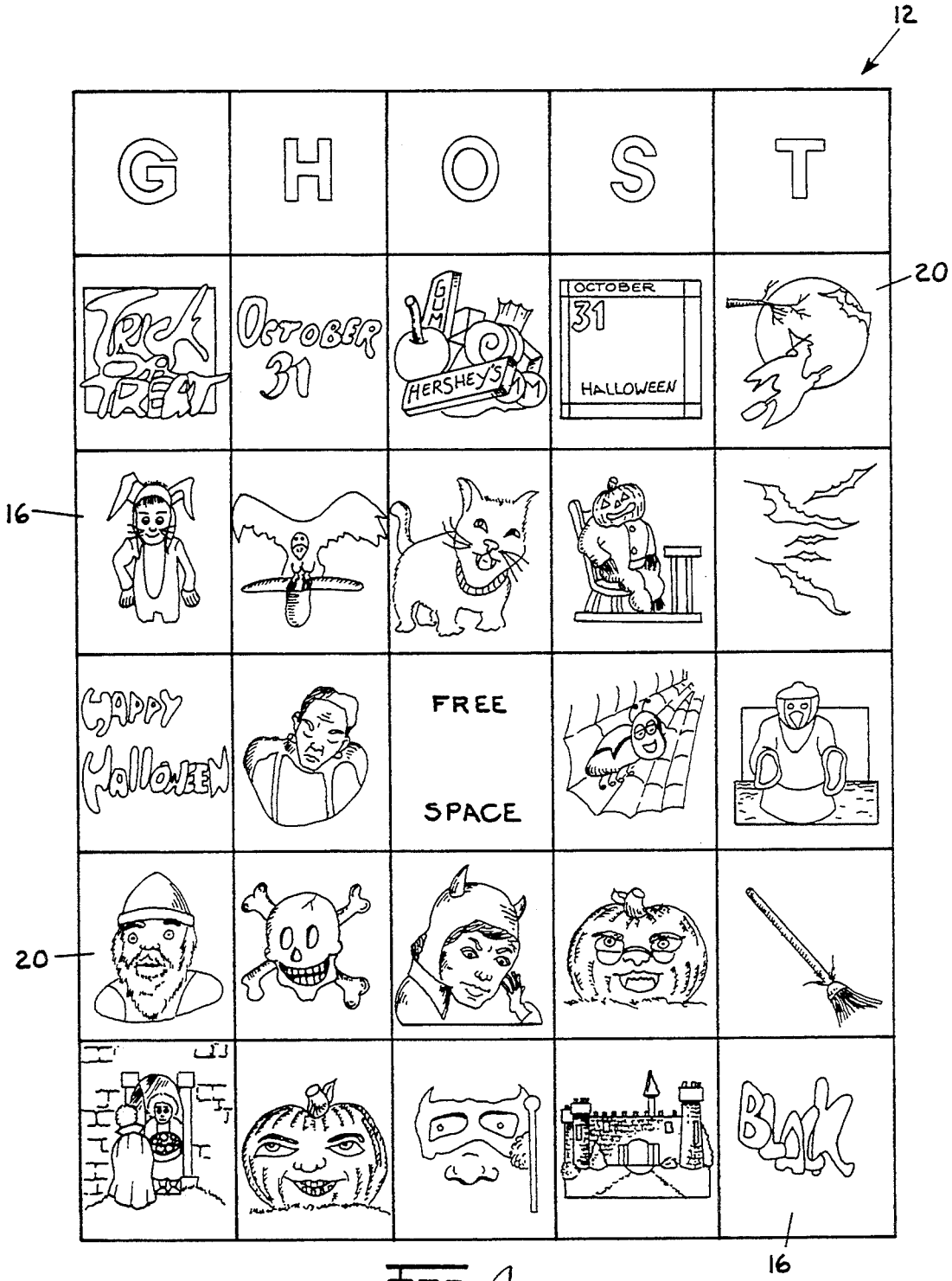
FIG. 4 illustrates a representative game playing card for a Halloween version of the holiday Bingo-type game.
Figure 6:
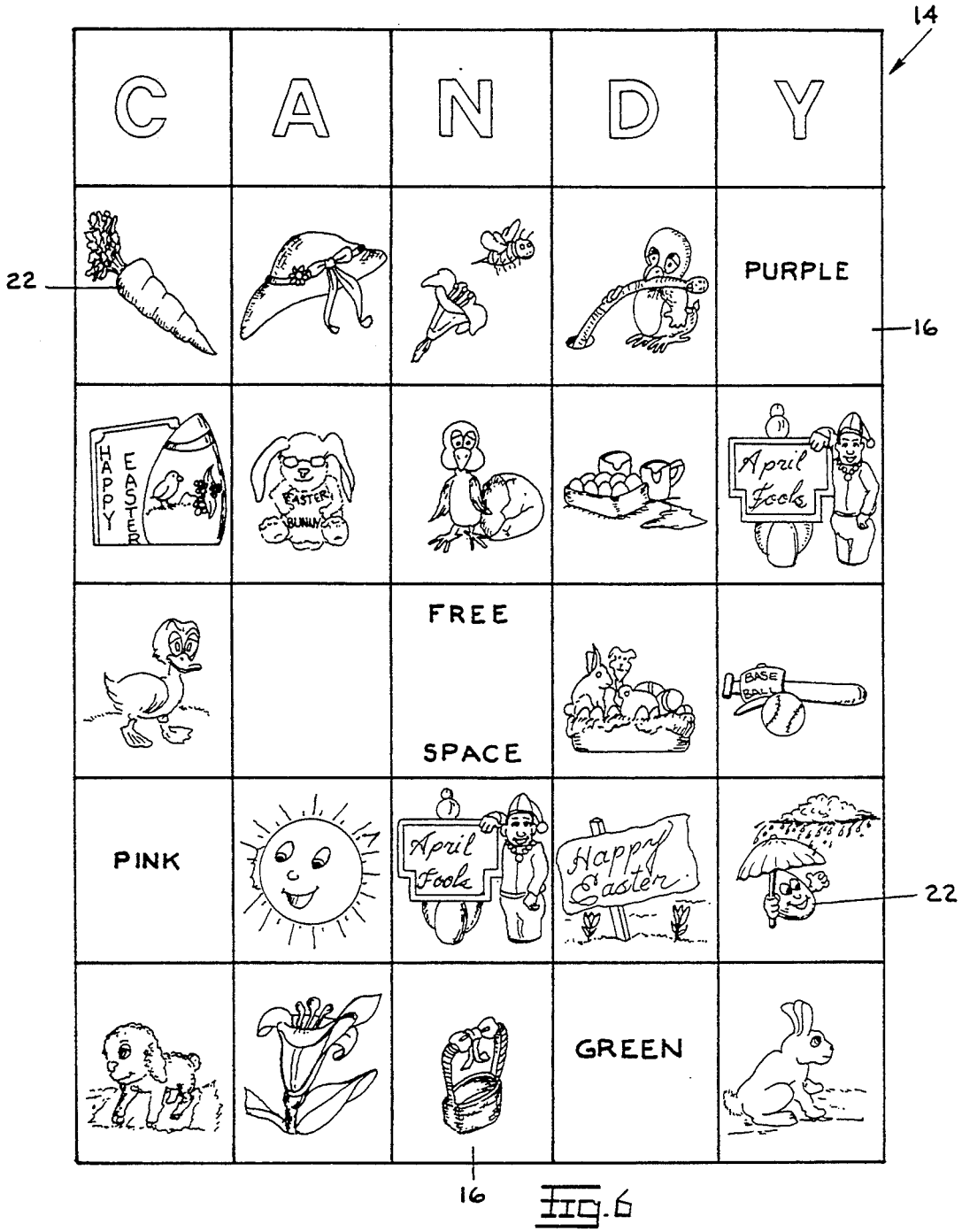
FIG.6 illustrates a representative game playing card for an Easter version of the holiday Bingo-type game.
Figure 7:
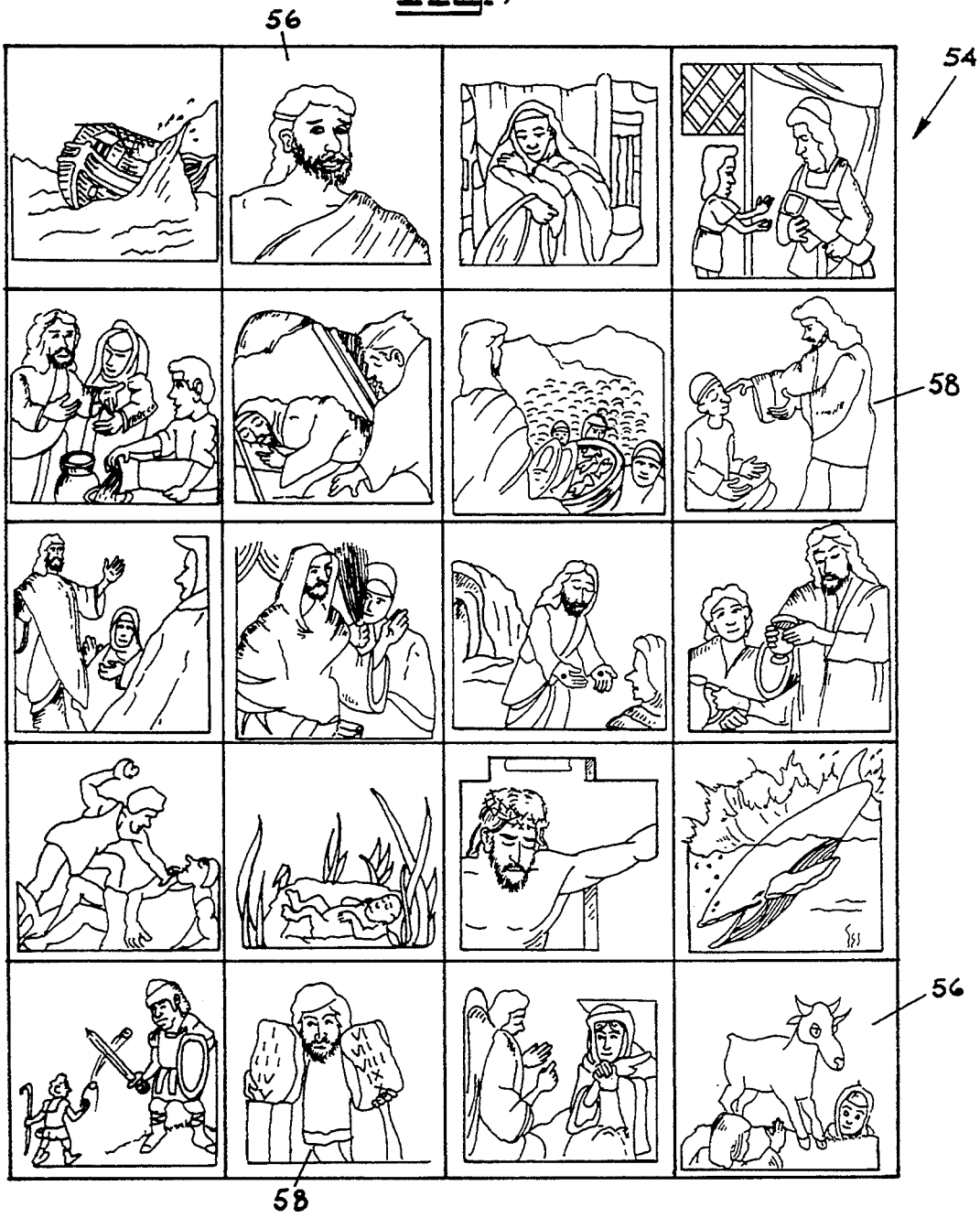
FIG. 7 illustrates a representative Bible story master calling card for the Bible story Bingo-type game.

FIGS. 2, 4, and 6 illustrate representative game playing cards 10, 12, and 14 used with particular holiday versions of the game. There does not need to be a fixed number of game playing cards although there should be a plurality of game playing cards to allow all of the children in a typical schoolroom or day care center to play the game. Generally speaking, thirty game playing cards for each version would be required to allow play of the game by all children in a typical elementary school classroom or day care center. The cards 10, 12, and 14 may be manufactured of cardboard with a vinyl covering and should have a surface that is easily cleaned. Each card 10, 12, and 14 will contain a plurality of equally-sized, square-shaped playing card grids 16. The presently preferred arrangement of grids 16 is a five-row by five-column layout. Each grid 16 contains a representation of a unique playing card indicium or symbol related to a particular holiday. The card 10 illustrated by FIG. 2 contains symbols 18 related to Christmas; the card 12 of FIG. 4 contains symbols 20 related to Halloween; and FIG. 6 illustrates a card 14 containing symbols 22 related to Easter. FIGS. 2, 4, and 6 are only representative game playing cards for the respective version of the game, and the placement of symbols 18, 20, and 22 on each card 10, 12, and 14 will vary from card to card.

Figure 1:
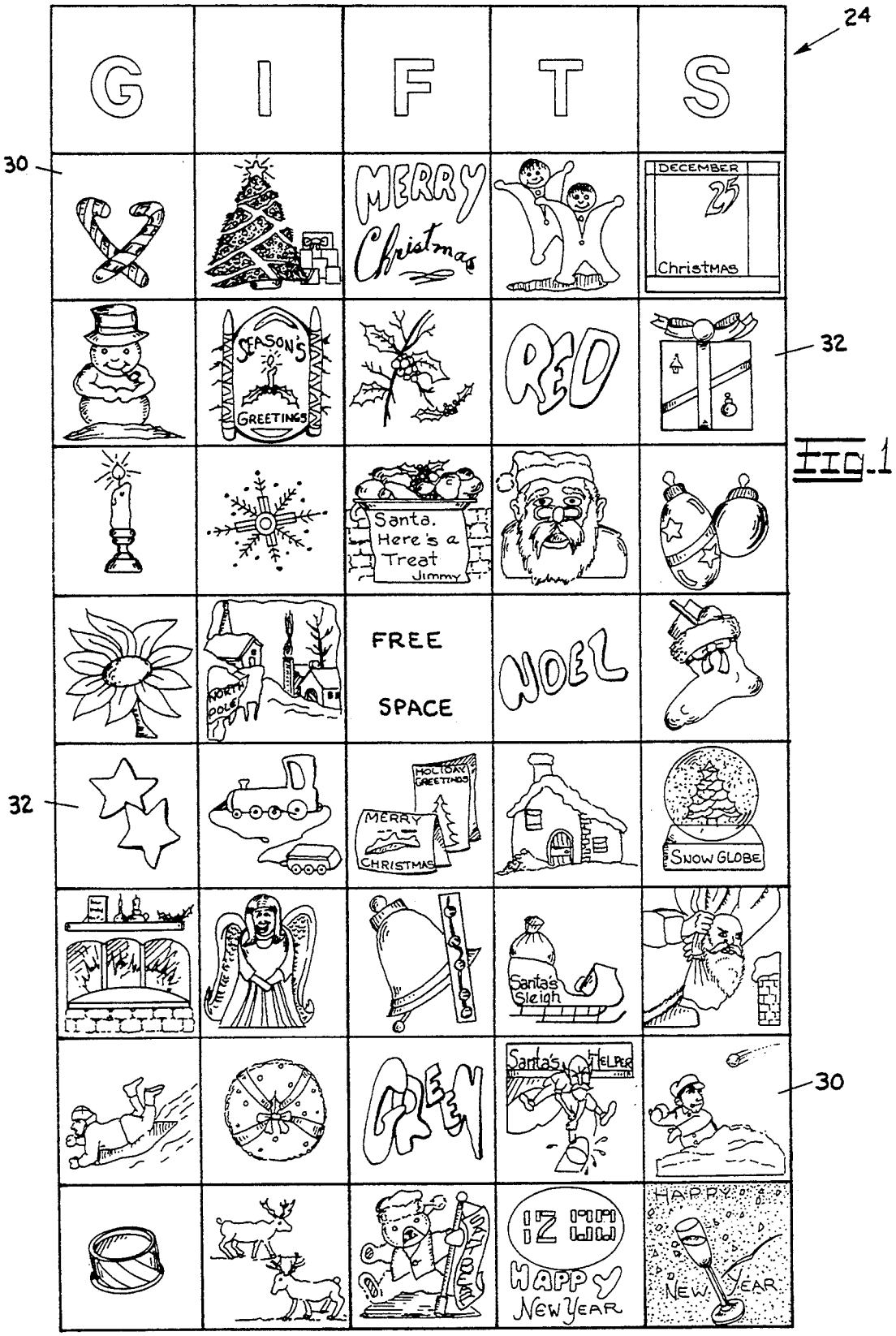
FIG. 1 illustrates a representative master calling card for a Christmas version of the holiday Bingo-type game.
Figure 3:
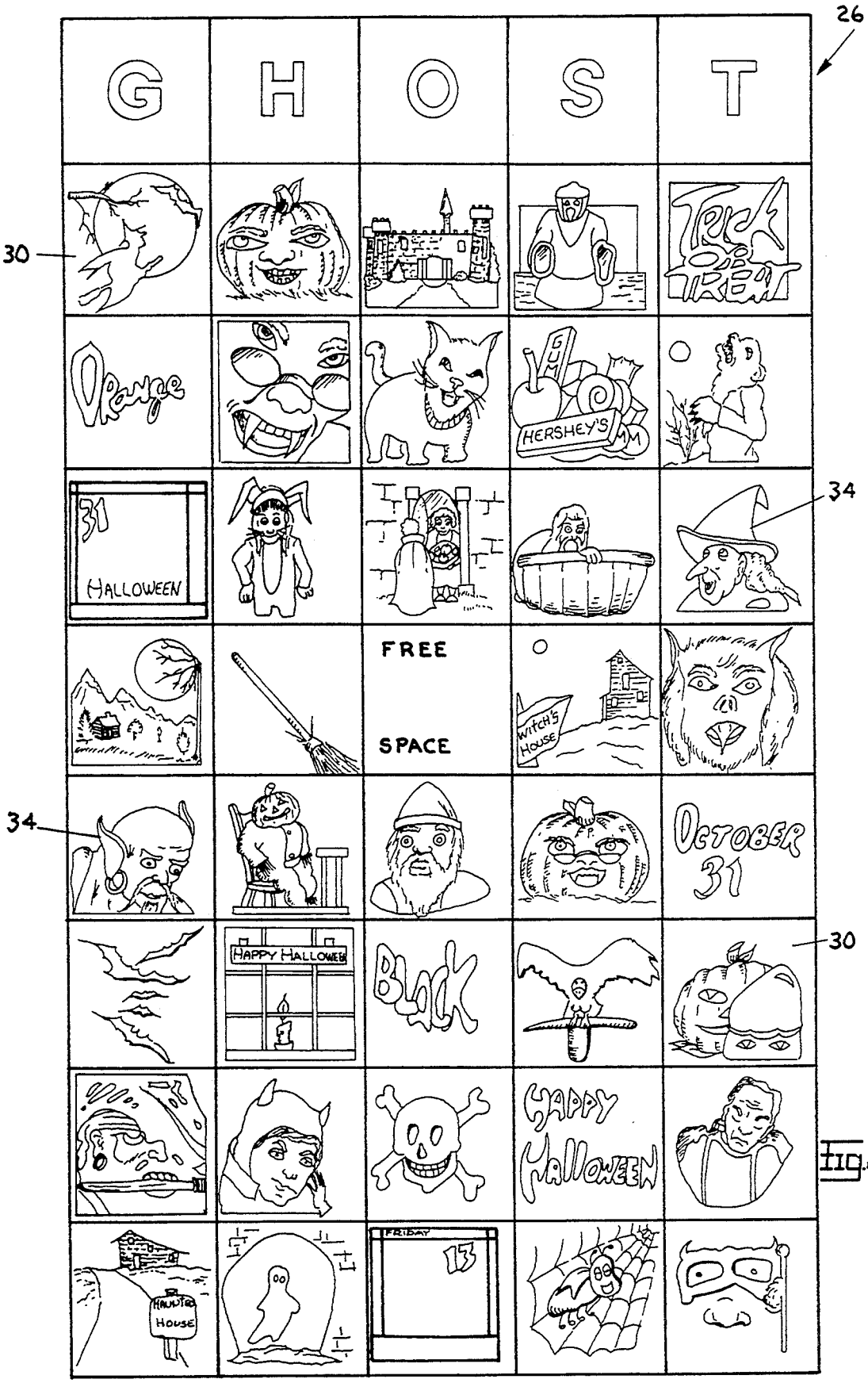
FIG. 3 illustrates a representative master calling card for a Halloween version of the holiday Bingo-type game.
Figure 5:
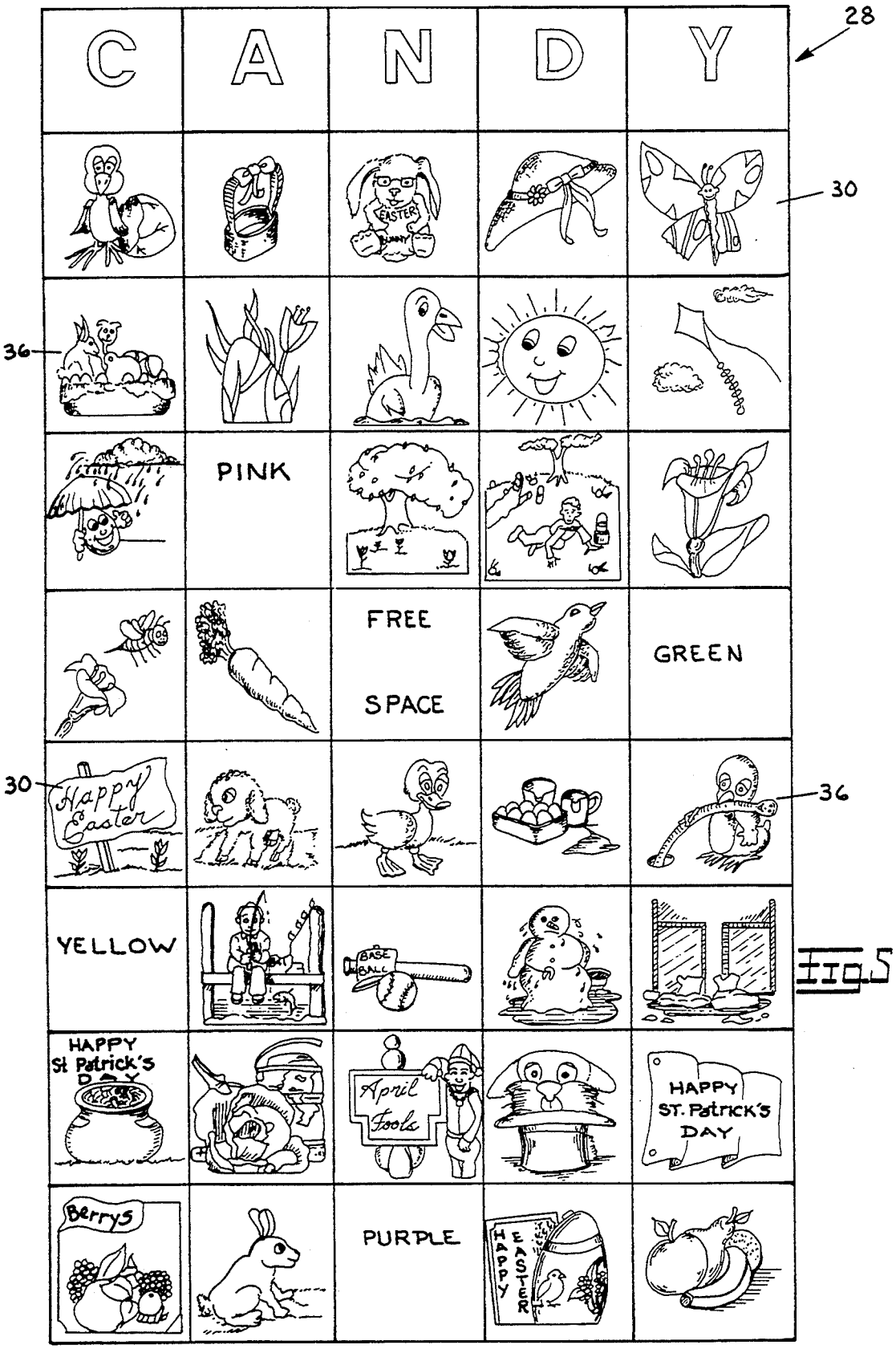
FIG. 5 illustrates a representative master calling card for an Easter version of the holiday Bingo-type game.

FIGS. 1, 3, and 5 illustrate the representative master calling card for each respective holiday version of the game. At least one master calling card must be used with each respective version of the game; the master card 24 of FIG. 1 is paired with 10 the representative card 10 of FIG. 2, the master card 26 of FIG. 3 is paired with the representative card 12 of FIG. 4, and the master card 28 of FIG. 5 is paired with the representative card 14 shown in FIG. 6. Each master card 24, 26, and 28 contains a plurality of equally-sized, square-shaped calling card grids 30. Each grid 30 contains a representation of a unique calling card symbols 32, 34, and 36 which is related to that respective holiday version of the game. Every symbol 18, 20, and 22 shown on the collective cards 10, 12, and 14 must be represented at least once on the master cards 24, 26, and 28, thus the grid arrangement of the master cards 24, 26, and 28 must be larger than each respective card 10, 12, and 14. The presently preferred grid arrangement or layout of the master cards 24, 26, and 28 illustrated in FIGS. 1, 3, and 5 is a five-column by eight-row grid layout.

Figure 9:
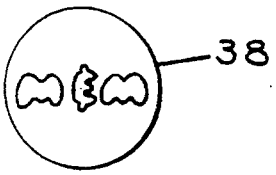
FIG. 9 illustrates a representative marker used with a Christmas version of the holiday Bingo-type game.
Figure 10:
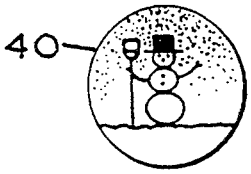
FIG. 10 illustrates a representative marker used with a Christmas version of the holiday Bingo-type game.

In order to enhance the appeal of the game, especially for children, a unique marker means is utilized for play of each version of the game. The marker means are used by the players to cover the appropriate grid 16 on their respective cards 10, 12, and 14 containing the symbol 18, 20, and 22 which corresponds to the respective symbol 32, 34, and 36 called out during play of the game by the school teacher or the day care center supervisor. The marker means are designed to relate to the respective versions of the game. FIGS. 9 and 10 illustrate the marker means used for the Christmas version of the game. FIG. 9 illustrates a representative sample of a red or green M&M 38 associated with Christmas; in the actual game a plurality of red and green M&M's would be used. For a typically-sized elementary school classroom, several hundred M&M's would be used. After play of each game, the players have the choice of saving their M&M's or eating them. In addition, the illustration of FIG. 9 could also represent a flat disc having the M&M's marking thereon. FIG. 10 illustrates another type of marker that can be used with the Christmas version of the game. The marker 40 of FIG. 10 is a small clear disc in which the figure of a snowman is enclosed, and when the disc is shaken, a snow-like illusion occurs. In place of the snowman, a reindeer, sleigh, or Santa Claus can be used.

Figure 11:
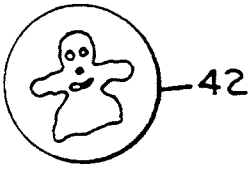
FIG. 11 illustrates a representative marker used with a Halloween version of the holiday Bingo-type game.
Figure 12:
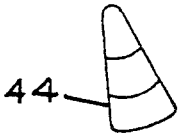
FIG. 12 illustrates a representative marker used with a Halloween version of the holiday Bingo-type game.

FIGS. 11 and 12 illustrate markers 42 and 44 to be used with the Halloween version of the game. FIG. 11 shows a glow-in-the-dark marker 42 having a symbol thereon representative of Halloween. In the representative marker 42 shown in FIG. 11, the symbol is of a ghost but any other figure commonly associated with Halloween, such as a witch, broomstick, or pumpkin, may be used.

FIG. 12 illustrates a representative candy corn marker 44 which may also be used with the Halloween version of the game. As with the M&M marker 38 illustrated in FIG. 9, several hundred candy corn markers 44 will need to be used with the Halloween version of the game and, after the game is completed, the players may eat the candy corn markers 44.

Figure 13:
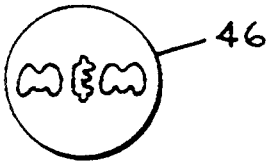
FIG. 13 illustrates a representative marker used with an Easter version of the holiday Bingo-type game.
Figure 14:
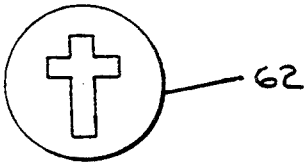
FIG. 14 illustrates a representative marker used with the Bible story Bingo-type game.
Figure 15:
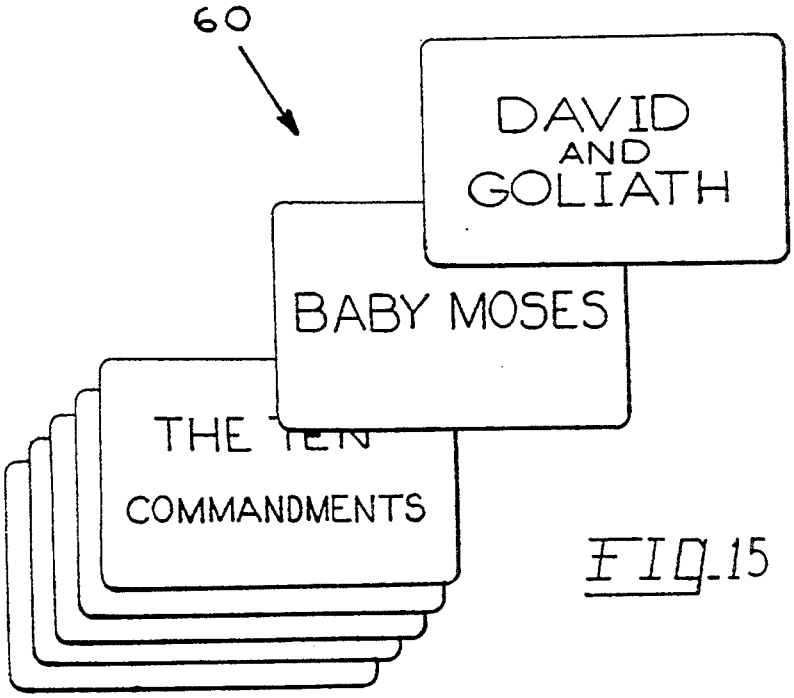
FIG. 15 illustrates a representative sample of Bible story cards used with the Bible story Bingo-type game.
Figure 19:
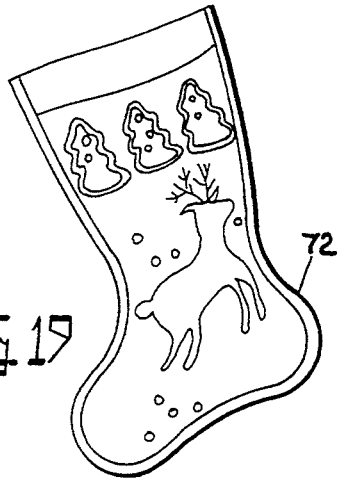
FIG. 19 illustrates a representative Christmas stocking used during play of an alternate preferred embodiment of the holiday Bingo-type game.
Figure 20:
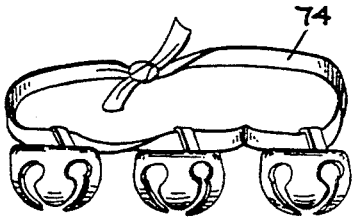
FIG. 20 illustrates a representative Christmas ribbon with bells attached thereto for use during play of an alternate preferred embodiment of the holiday Bingo-type game.

FIG. 13 illustrates a representative example of a pastel-colored M&M which is used as a marker 46 for the Easter version of the game. Several hundred pastel-colored M&M's 46 will be needed for the play of the Easter version of the game, and as with the green and red M&M's 38 shown in FIG. 9 and the candy corn marker 4 shown in FIG. 12, the pastel-colored M&M's 46 of FIG. 13 can be eaten after play of the game by the players. The markers 38, 40, 42, 44, or 46 shown in FIGS. 9–13 will be placed to cover the symbol 18, 20, or 22 on the card 10, 12, or 14 when that symbol 18, 20, or 22 is called out by the teacher or instructor from the master card 24, 26, or 28 during play of the game.

In order to play the game, the cards 10, 12, or 14 are distributed to the players, each receiving at least one card 10, 12, or 14. Depending upon which version of the game is being played, the respective markers 38, 40, 42, 44, or 46 illustrated in FIGS. 9–13 are distributed to the players for covering the symbols 18, 20, or 22 within the grids 16 as the corresponding symbols 32, 34, or 36 on the master calling card 24, 26, or 28 are called out by the teacher.

As the teacher randomly selects and calls out a symbol 32, 34, or 36, the players subsequently cover the symbol 18, 20, or 22 on their respective card 10, 12, or 14 that corresponds to the symbol 32, 34, or 36 called out by the teacher. When a player obtains a vertical, horizontal, or diagonal line, that player raises his or her hand, or yells out the designation at the top of the card - "GIFTS", "GHOST", or "CANDY"—and that player is declared the winner. The cards 10, 12, or 14 are then cleared off and the players can either eat the markers (if they are candy corn 44 as shown in FIG. 12 or M&M's 38 or 46 as shown in FIG. 9 and 13) or move the markers 38–46 to the side and prepare to play the next game.

Figure 8:
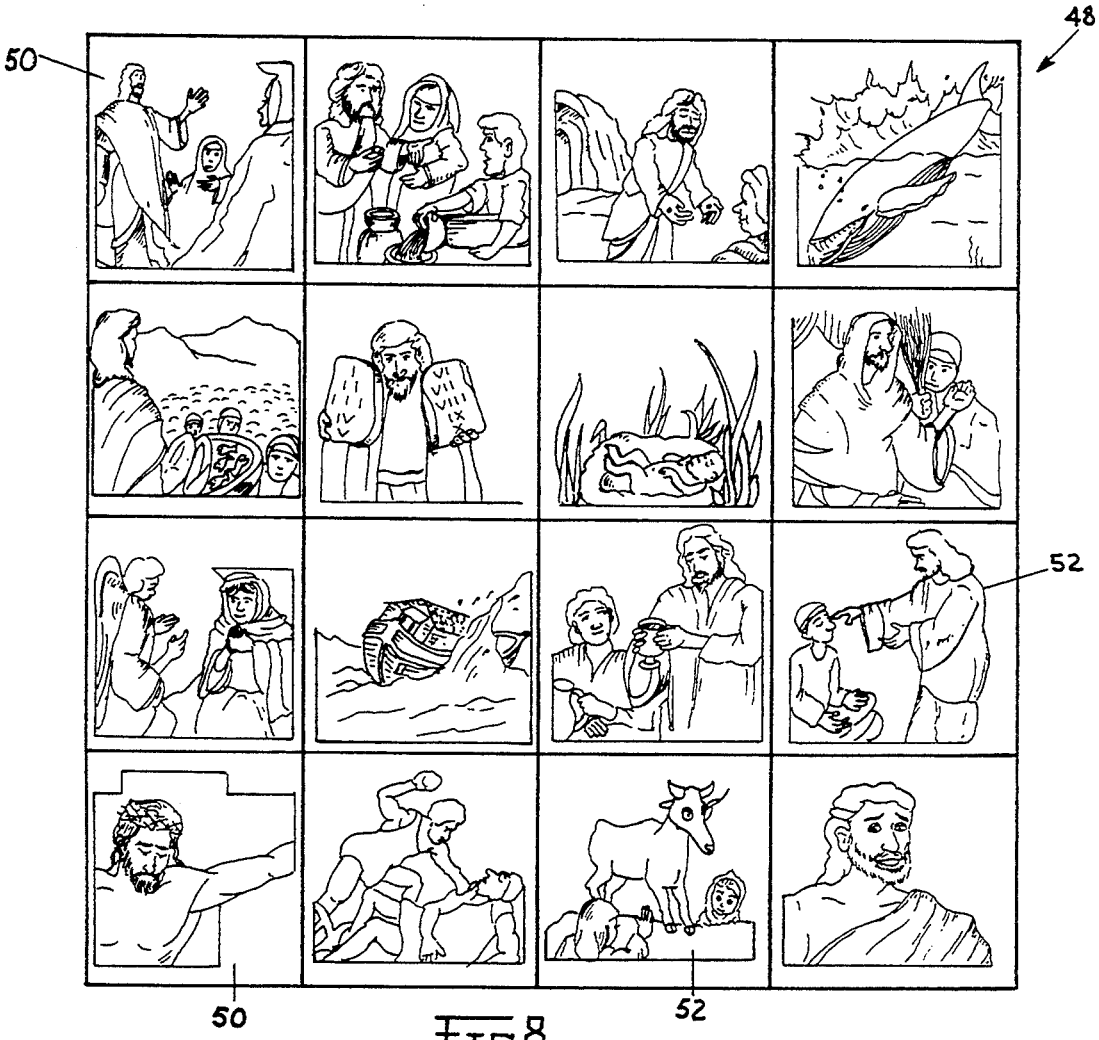
FIG. 8 illustrates a representative Bible story playing card for the Bible story Bingo-type game.

FIGS. 7, 8, 14, and 15 illustrate a Bible story Bingo-type game for play in various settings, such as at home or at private religious schools, day care centers, and churches. A plurality of players, primarily children but not exclusive of adults, can play the Bible story game. The Bible story game includes a plurality of Bible story playing cards 48 of which FIG. 8 is a representative example. The card 48 of FIG. 8 contains a plurality of equally-sized Bible scene grids 50, and each grid 50 contains a unique illustration 52 representing a Biblical event. The events are taken from both the Old Testament and the New Testament. The Bible story game also includes one Bible story master calling card 54 illustrated in FIG. 7 containing a plurality of equally-sized master card grids 56, and each grid 56 contains a unique illustration 58 of a Biblical event. The Biblical events illustrated on master card 54 correspond to the Biblical events represented on the respective cards 48. The grid layout of the cards 48 and the master card 54 can vary. In the presently preferred embodiment, the cards 48 are laid out on four-column by four-row grids and the master card 54 is laid out on a four-column by five-row grid. In order to call out the various Biblical events on the master card 54, the Bible story game includes a plurality of Bible story cards 60. Each card 60 has a written description thereon which corresponds to one unique Biblical event 58 illustrated on the master card 54.

Also, the Bible story Bingo-type game includes a marker means for use by each player in covering the grids 50 on his or her card 48 during play of the game. In the presently preferred embodiment of the game, the marker means includes a plurality of Bible game playing discs 62, each containing a symbol of a cross thereon.

In the play of the game, the teacher will randomly select a Bible story card 60 and will recite aloud the written description of the Biblical event contained thereon. The players will cover the illustration 52 on their cards 48 that corresponds to the recited Biblical event with their discs 62. When one player has horizontally, vertically, or diagonally covered the appropriate grids 50 on his or her card 48, he or she will shout "AMEN". Then the player, or players if they are playing in teams, will briefly explain to their classmates the nature and importance of the Biblical events which make up their "AMEN".

An alternative to the holiday Bingo-type game shown in FIGS. 1–6 is illustrated in FIGS. 16–21. While keeping the essential Bingo-type format of the holiday Bingo-type game of FIGS. 1–6, the alternative preferred embodiment of the holiday Bingo-type game whose main playing elements are shown in FIGS. 16–20 includes features making the game especially enjoyable for small children around the ages of 3 to 5.

Figure 16:
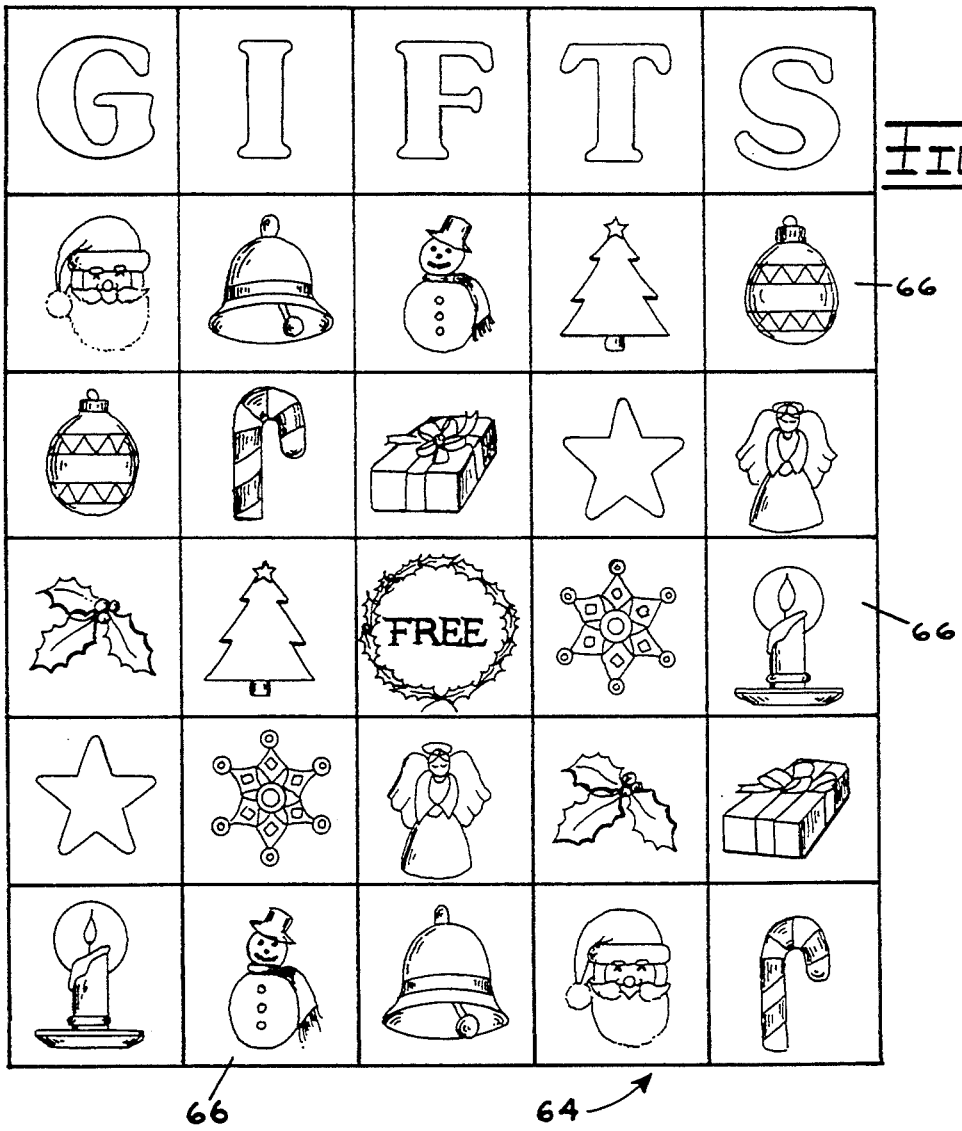
FIG. 16 illustrates a representative game playing card for the alternate preferred embodiment of the holiday Bingo-type game.

Shown in FIG. 16 is a representative example of a holiday game playing card 64 for the Christmas version of the game. Unlike the symbols on cards 18 and 24 of the Christmas version of the game shown in FIGS. 1 and 2, the indicium or symbols 66 of card 64 have been greatly simplified for easy and quick understanding by 3- to 5-year-olds. Each symbol 66 located within the grid of card 64 may be a removable sticker with an adhesive backing for permitting adhesion on the cards, such as card 64 shown in FIG. 16, and removal therefrom after the game is played, or whenever the player so desires to remove the stickers. The symbols 66 may also be in the form of non-removable stickers so that when the symbols 66 are distributed within the grids of card 64, the arrangement of the symbols 66 on the card 64 thereby becomes permanent.

Figure 17:
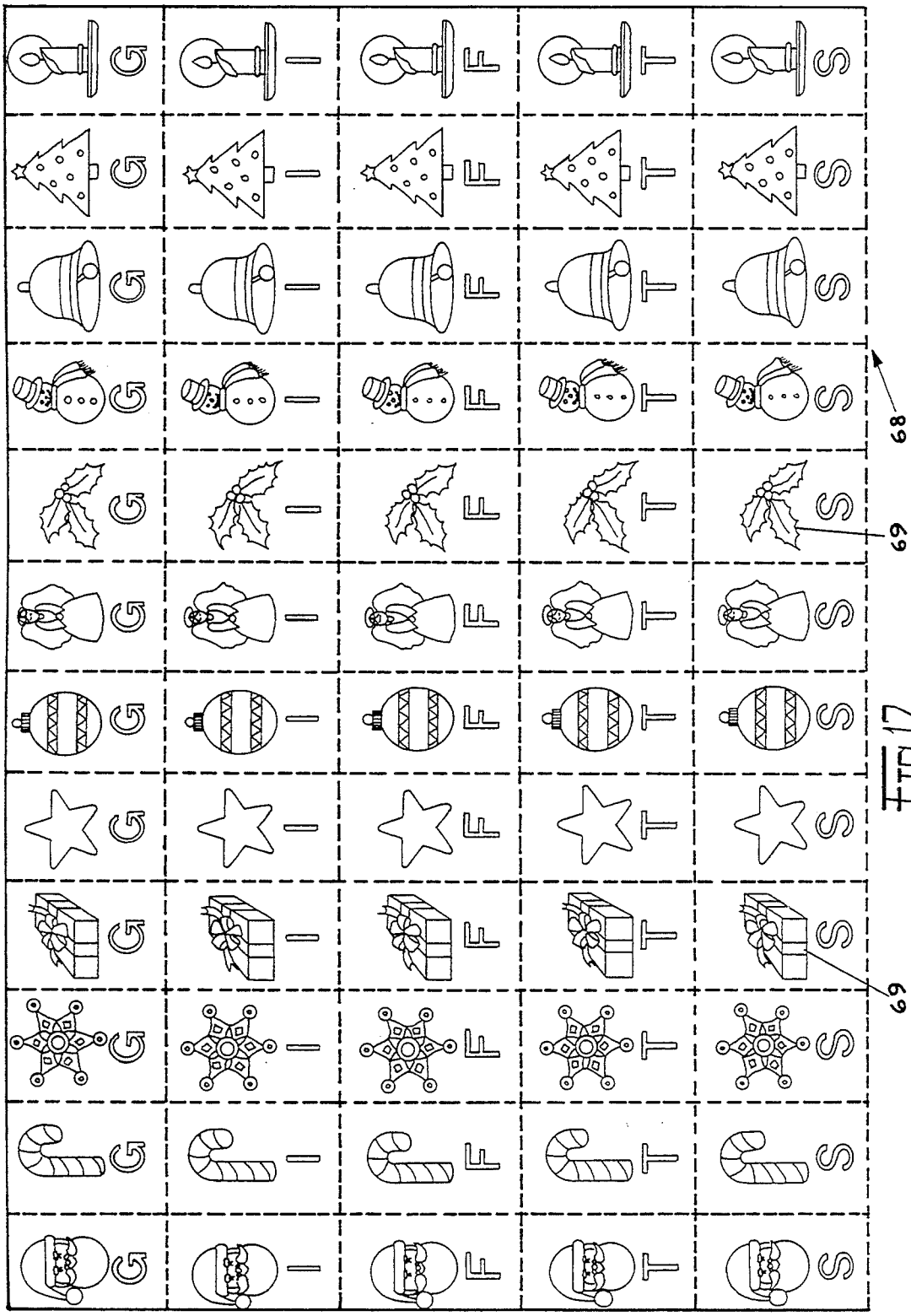
FIG. 17 illustrates a representative caller match-up card for an alternate preferred embodiment of the holiday Bingo-type game.

FIG. 17 illustrates a representative example of a caller match-up card 68 for the Christmas version of the alternative embodiment of the holiday Bingo-type game. In addition, a caller cut-out card (not shown) is also used. The caller cut-out card is not shown because it is an exact duplicate of the caller match-up card 68.

Before play of the game commences, a container appropriate for the particular version (a Christmas stocking for Christmas, pumpkin jar or jack-o'-lantern for Halloween, Easter basket for Easter, etc.) will be provided. Each separate symbol found on the caller cut-out card will be cut out, then all the cut out symbols will be placed into the appropriate holiday container. During play of the game, one individual, designated the caller (or, more fancifully, "Head Elf", "Easter Bunny's Helper", "Pumpkin Leader", etc.) will reach into the container and pull out one symbol, calling out both the letter and the symbol.

The caller will then place that symbol over the same symbol 69 as found on the caller match-up card 68 beginning in the first row and then progressively filling each row and column until there is a Bingo. If no player responds with a Bingo, the caller will continue pulling out symbols from the container and placing those symbols over the same symbols 69 found on the caller match-up card 68. The players can use the markers illustrated in FIGS. 9–13 to cover their respective playing card 64 during play of the game.

Figure 18:
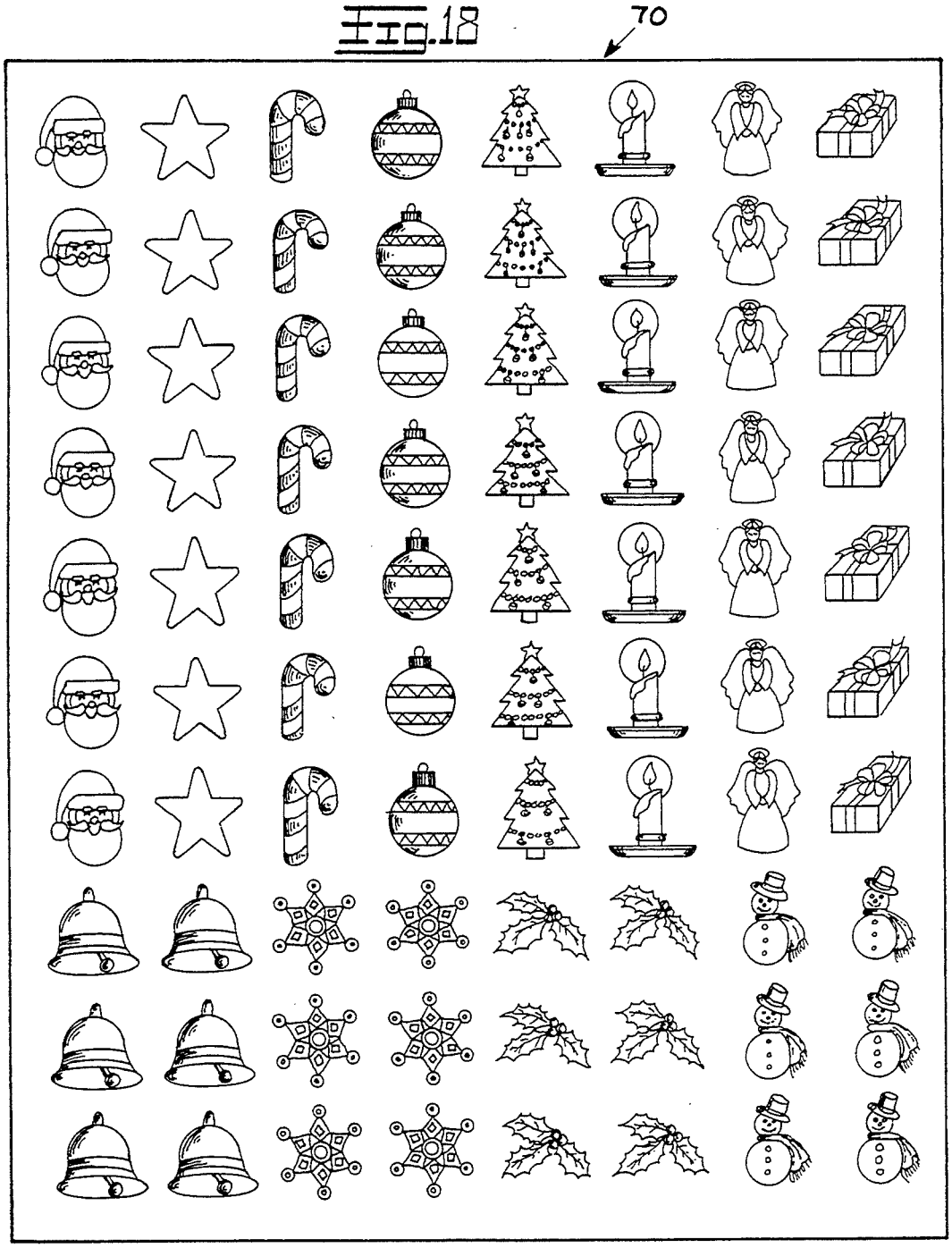
FIG. 18 illustrates a representative sticker sheet containing symbols for placement on the game playing card first shown in FIG. 16.

Moreover, to enhance the appeal of the game for small children in the ages 3–5 group, the holiday Bingo-type game allows each child to design their own card. This is done by providing sticker sheets which would contain the stickers such as those that are shown on FIG. 16 and which represent the symbols 66 placed on the representative card 64. FIG. 18 illustrates one representative sticker sheet 70. The sticker sheets will contain the same symbols as the symbols 69 arranged on the caller match-up card 68 shown in FIG. 17. The symbols 69 represent themes or motifs derived from that particular version of the holiday Bingo-type game; the symbols 69 are obviously derived from Christmas. Each young child would be instructed to cut out or remove two stickers for each symbol from the sticker sheet 70 provided for each child and then randomly place those stickers on the card, such as on representative playing card 64 of FIG. 16, making certain that no two stickers are in the same winning Bingo lines either horizontally, vertically, diagonally, or at the corners. Each child will be instructed to fill up at least one playing card 64 by randomly distributing stickers taken from the sticker sheet 70; the playing card 64 illustrated in FIG. 16 is one representative example of a playing card having randomly distributed symbols 66 that can be created by the children themselves. If the game utilizes a type of non-removable sticker, then the distribution of symbols 66 on the card 64 will be permanent; if removable stickers are used, then the distribution of symbols 66 within the grids of a playing card, as illustrated in representative playing card 64, can be changed after the play of each game. Thus, with the use of removable stickers, each child could create as many unique playing cards as allowed by the random distribution and placement of the symbols 66 on each representative playing card 64.

In order to play the Christmas version of the holiday Bingo-type game, one person (usually an adult) will be designated the caller (or "Head Elf", in keeping with the seasonal spirit of the game). The "Head Elf" will have the caller match-up card 68 set before him or herself, and all the symbols on the caller cut-out card will have already been cut out and placed in a container, such as a Christmas stocking 72 shown in FIG. 19. Each child will have created at least one playing card, such as card 64, by applying the removable or non-removable stickers derived from the several sticker sheets 70 within the grids of the card 64. Seasonal markers will be distributed to each child, such as red and green gumdrops or the markers 38 and 40 illustrated in FIGS. 9 and 10.

The caller will pass out approximately 15 markers to each player. Actual play of the game will commence by the caller randomly selecting a symbol from the stocking 72. The caller will call out the letter and symbol selected, and then place that symbol over the matching symbol 69 on the caller match-up card 68. The players will use the appropriate markers to cover the symbol 66 on their game playing cards 64 that matches the symbol selected from the stocking 72 and called out by the caller. The caller will continue selecting symbols from the stocking 72 until one of the players calls out the functional equivalent of "Bingo", i.e., in the Christmas version of the game, the player could call out "GIFTS". In the alternative, the player whose card shows a winner in any one of the four standard ways (diagonal, vertical, horizontal, four corners) could shake a Christmas ribbon 74, illustrated in FIG. 20, tied into a circle and having several small bells attached to it. Before play of the game, one Christmas ribbon 74 with bells attached could be distributed to each player. All other versions of the alternative embodiment of the holiday Bingo-type game would follow the same game-playing format.

It is also anticipated that other versions of the holiday Bingo-type game could be developed using a simplified playing card, such as card 64, only with symbols appropriate to another particular holiday placed thereon. In addition, the caller match-up cards and the caller cut-out cards would have a format similar to card 68, only they would include symbols appropriate to that respective holiday. The markers for use by the players could be those shown in FIGS. 11—13 as well as others, such as jelly beans for the Easter version.

Figure 21:
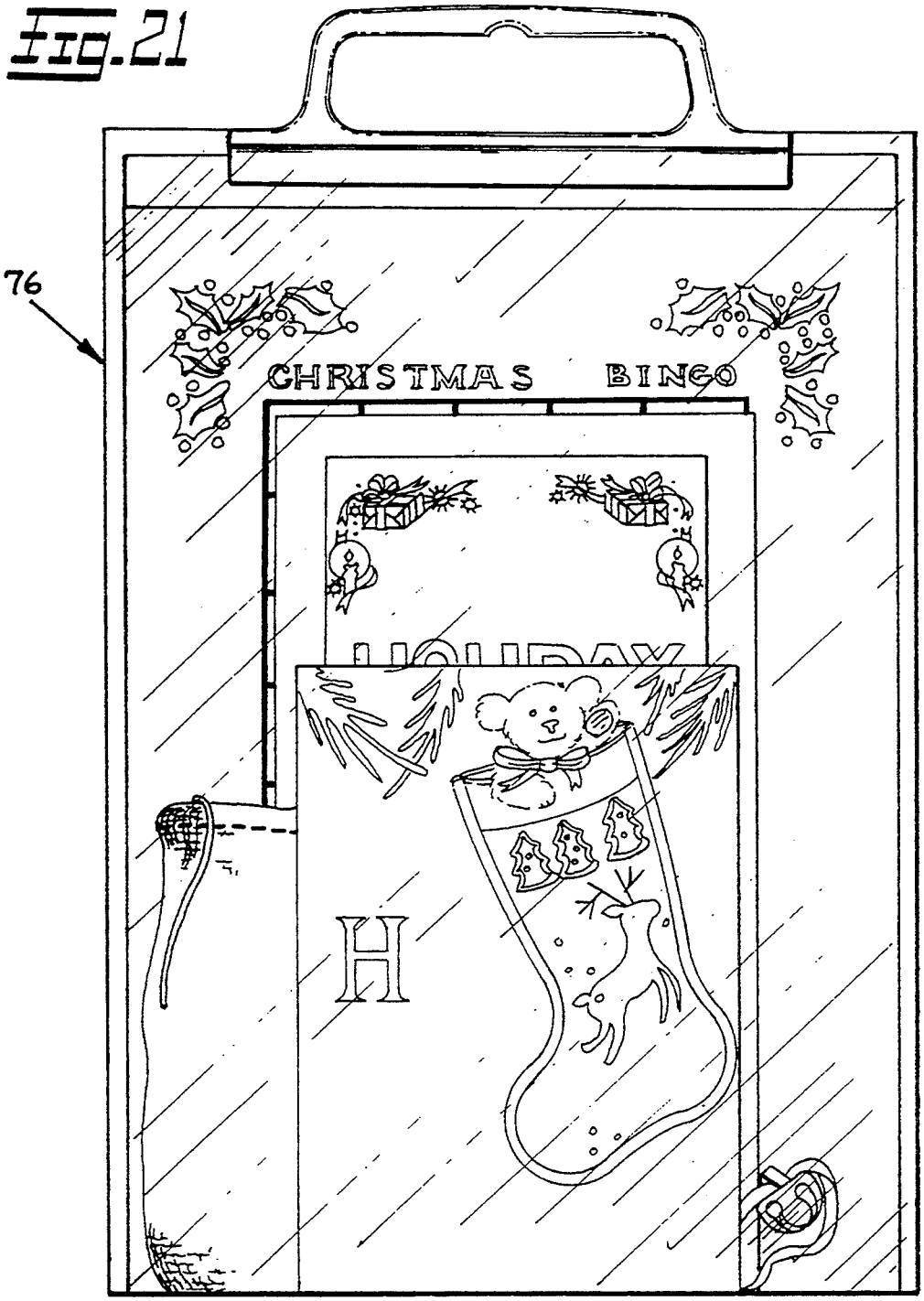
FIG. 21 illustrates a representative clear plastic bag used as a container for the game elements of an alternate preferred embodiment of the holiday Bingo-type game.

The Christmas version of the alternate embodiment of the holiday Bingo-type game may be packaged and sold in a variety of ways. One preferred form for selling the Christmas version of the game shown in FIGS. 16–20 is to place the game playing items in a clear plastic bag 76, which serves as both the storage and carrying means, as shown in FIG. 21, including: one caller cut-out card; one caller match-up card 68; six blank playing cards, such as playing card 64 shown in FIG. 16; two sticker sheets, such as sticker sheets 70 shown in FIG. 18; and 100 markers, such as markers 40 and 42 illustrated in FIGS. 10 and 11. A container for the symbols removed from the caller cut-out card, such as the stocking 72, and also the Christmas ribbon 74 would be included in the bag 76.

The various other holiday versions of the alternative embodiment of the holiday Bingo-type game would include the same above-described elements except that the symbols would be congruent with that particular version of the holiday Bingo-type game being sold.

Although several embodiments of the present invention have been illustrated and described, it will be apparent to those skilled in the art that various changes and modifications may be made therein without departing from the spirit of the invention or the scope of the appended claims.

I claim:

1. A children's game incorporating motifs from a number of holidays, comprising:

at least one caller match-up card containing a plurality of grids with each grid containing a symbol or indicium representative of a particular holiday;

at least one caller cut-out card containing a plurality of symbols or indicia representative of a particular holiday, with each symbol or indicium capable of being cut out and removed therefrom for placement on a caller match-up card during play of the game;

a plurality of holiday game-playing cards with each holiday game-playing card containing a plurality of blank playing grids arranged thereon;

a plurality of sticker sheets with each sticker sheet containing an array of symbols or indicia representing themes derived from a particular holiday; and marker means having indicia thereon which are related to a particular holiday, and which are used to cover the holiday game-playing card grids during play of the game.

2. The game of claim 1 wherein the indicia on the sticker sheets are in the form of removably attachable stickers that can be removed from the sticker sheets for random distribution within the blank playing grids of each game-playing card.

3. The game of claim 2 further comprising a container means for temporarily holding, during play of the game, all of the caller cut-out card symbols after they have been cut out and removed from the caller cut-out card.

* * * * *